US008498409B2

(12) United States Patent
Narayan

(10) Patent No.: US 8,498,409 B2
(45) Date of Patent: Jul. 30, 2013

(54) SYSTEMS AND METHODS FOR PROVIDING ACCESS TO WIRELINE COMMUNICATION EQUIPMENT

(75) Inventor: Rajesh Narayan, Alpharetta, GA (US)

(73) Assignee: AT&T Intellectual Property I, L.P., Atlanta, GA (US)

( * ) Notice: Subject to any disclaimer, the term of this patent is extended or adjusted under 35 U.S.C. 154(b) by 1662 days.

(21) Appl. No.: 11/860,088

(22) Filed: Sep. 24, 2007

(65) Prior Publication Data

US 2009/0078431 A1 Mar. 26, 2009

(51) Int. Cl.
*H04R 25/00* (2006.01)

(52) U.S. Cl.
USPC ..... 379/457; 379/296; 379/322; 379/323; 379/328; 379/329; 379/330; 455/347

(58) Field of Classification Search
USPC ..... 379/457, 296, 322, 323, 328, 329, 379/330
See application file for complete search history.

(56) References Cited

U.S. PATENT DOCUMENTS

| | | | | |
|---|---|---|---|---|
| 4,327,530 | A * | 5/1982 | Bush | 52/66 |
| 2005/0130621 | A1 * | 6/2005 | Flynn | 455/347 |
| 2009/0021017 | A1 * | 1/2009 | Steenstrup | 290/53 |

* cited by examiner

*Primary Examiner* — Davetta W Goins
*Assistant Examiner* — Jasmine Pritchard
(74) *Attorney, Agent, or Firm* — Hartman & Citrin LLC

(57) ABSTRACT

Systems and methods for providing access to wireline communication equipment are disclosed. Exemplary methods include positioning the wireline communication equipment at least partly below ground level, positioning an electric-powered lifting device near the wireline communication equipment and at least partly below the ground level, connecting the electric-powered lifting device to the wireline communication equipment, and configuring the lifting device to lift the wireline communication equipment above the ground level when access to the wireline communication equipment is desired.

18 Claims, 7 Drawing Sheets

SYSTEMS AND METHODS FOR PROVIDING ACCESS TO WIRELINE COMMUNICATION EQUIPMENT

TECHNICAL FIELD

This application relates generally to the field of telecommunications. More specifically, this application relates to providing access to wireline communication equipment.

BACKGROUND

Telecommunication utility boxes such as, for example, telephone company pedestal boxes are often located throughout various neighborhoods. Such utility boxes may include equipment such as routers, repeaters, digital subscriber line (DSL) cards, and telephone switches. People living or working near such utility boxes often find the appearance of the boxes to be undesirable. Another problem with telecommunication utility boxes is that they are susceptible to damage caused by various factors including weather, vandalism, and accidents. There are also concerns that unauthorized access to a utility box may enable illegal activity such as wiretapping.

SUMMARY

Exemplary embodiments of systems and methods for providing access to wireline communication equipment are described. Exemplary methods include positioning the wireline communication equipment at least partly below ground level, positioning an electric-powered lifting device near the wireline communication equipment and at least partly below the ground level, connecting the electric-powered lifting device to the wireline communication equipment, and configuring the lifting device to lift the wireline communication equipment above the ground level when access to the wireline communication equipment is desired.

Other exemplary methods include using an electric-powered lifting device to lift wireline communication equipment positioned at least partly below a ground level of an area near the wireline communication equipment, the lifting device being positioned at least partly below the ground level, accessing the wireline communication equipment after the wireline communication equipment is lifted by the lifting device, and using the lifting device to lower the wireline communication equipment after accessing the wireline communication equipment.

Exemplary systems include wireline communication equipment positioned at least partly below ground level, and an electric-powered lifting device positioned near the wireline communication equipment and at least partly below the ground level, the electric-powered lifting device being connected to the wireline communication equipment and being configured to lift the wireline communication equipment above the ground level when access to the wireline communication equipment is desired.

Other systems, methods, and/or computer program products according to embodiments will be or become apparent to one with skill in the art upon review of the following drawings and detailed description. It is intended that all such additional systems, methods, and/or computer program products be included within this description, be within the scope of the present invention, and be protected by the accompanying claims.

BRIEF DESCRIPTION OF THE DRAWINGS

The components in the figures are not necessarily to scale, emphasis instead being placed upon illustrating the principles of the invention. In the figures, like reference numerals designate corresponding parts throughout the different views.

DETAILED DESCRIPTION

The following detailed description is directed to systems and methods for providing access to wireline communication equipment. In the following detailed description, references are made to the accompanying drawings that form a part hereof, and which are shown by way of exemplary embodiments and implementations.

Figure 1A:
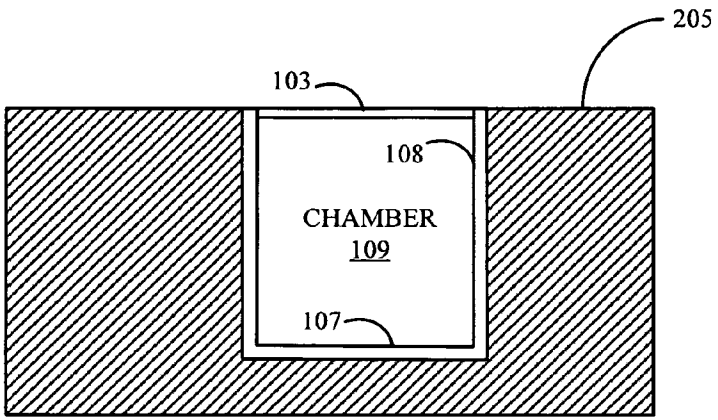
FIGS. 1A and 1B are diagrams depicting respective views of a chamber that can be used for housing a telecom unit and a lifting device, in accordance with exemplary embodiments.
Figure 1B:
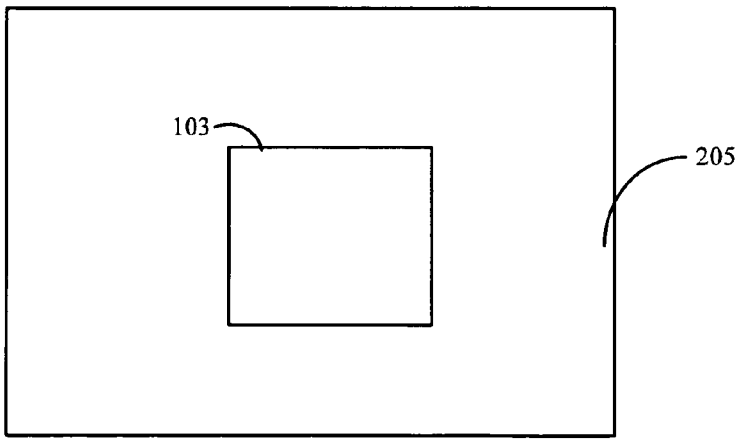

FIGS. 1A and 1B are diagrams depicting respective views of a chamber 109 that can be used for housing a telecom unit and a lifting device, in accordance with exemplary embodiments. FIG. 1A represents a cross-sectional side view, whereas FIG. 1B represents a top view. Note that the chamber 109 may have a different shape than that shown in the figures. For example, the chamber 109 may have a shape and size that is suitable for housing a particular telecom unit and/or a particular lifting device, depending on a desired implementation. The chamber 109 may be located above a surrounding ground 205, partially below the ground 205, or entirely below the ground 205.

The chamber 109 may have water resistant walls 108 and/or floor 107 for preventing water from seeping into the chamber 109 from the surrounding ground 205 when the chamber 109 is positioned below ground level. The water resistant walls 108 and/or floor may comprise, for example, among others, rubber, plastic, metal, concrete or any other water resistant material. The chamber 109 may have a cover 103 to prevent water or other unwanted material from entering into the chamber 109. The cover 103 may therefore be closed tightly enough to prevent water and/or air flow into the chamber 109 while the cover 103 is closed. Furthermore, the cover 103 may be lockable to prevent unauthorized access to the chamber 109. Alternatively, the cover 103 may require a special tool to enable removal of the cover 103. A solar panel (not shown in FIGS. 1A and 1B) may be attached to the cover 103. The solar panel can be used to provide power for recharging a battery used to power a lifting device, as will be discussed in more detail below.

Figure 2A:
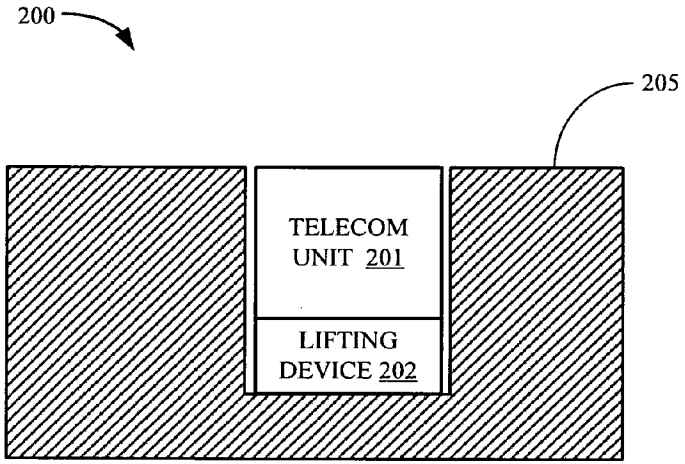
FIGS. 2A and 2B are diagrams illustrating a telecom unit access system, in accordance with exemplary embodiments.
Figure 2B:
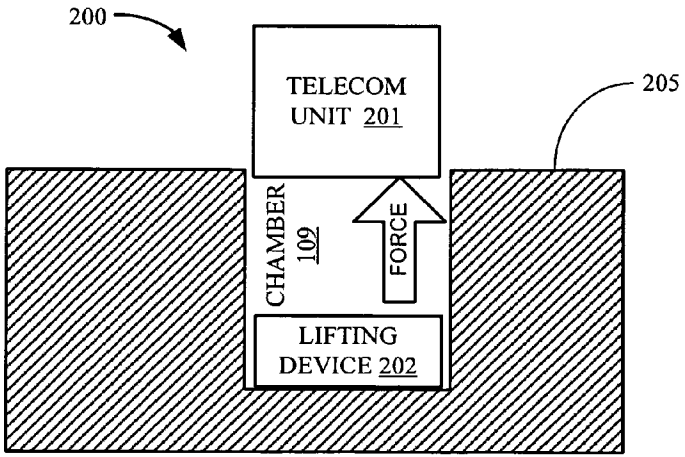

FIGS. 2A and 2B are diagrams illustrating a telecom unit access system 200, in accordance with exemplary embodiments. The system 200 includes a telecom unit 201 housed in the chamber 109 in the ground 205. Depending on the position of the chamber 109, the telecom unit 201 may be located above the ground 205, partially below the ground 205, or entirely below the ground 205. The telecom unit 201 may comprise wireline communication equipment such as, for example, routers, switches, repeaters, DSL cards, or any other wireline communication equipment. An exemplary embodiment of a telecom unit 201 is a pedestal box used by a telephone company to enable telephone services. The telecom unit 201 may be partially or fully lifted out of the chamber 109 to better enable work to be performed related to the telecom unit 201. Examples of work that may be performed related to the telecom unit 201 include maintenance, upgrades, device additions, and repairs.

The system 200 may be configured such that the telecom unit 201 can be lifted manually where the telecom unit 201 is not too heavy for a person to safely lift the telecom unit 201. Alternatively or additionally, the system 200 may be configured to enable the telecom unit 201 to be lifted by a lifting device 202. The lifting device 202 may be located (in whole or in part) in the chamber 109, outside the chamber 109, and/or adjacent to the chamber 109 (e.g., within the ground 205). The lifting device 202 may use hydraulic components, gears, pulleys, and/or any other components configured to enable lifting the telecom unit 201. The lifting device 202 may be integrated into the telecom unit 201 or may be a separate device.

Figure 2C:
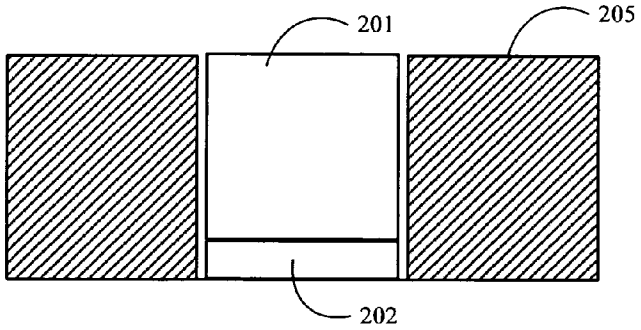
FIGS. 2C and 2D are schematic diagrams depicting a hydraulic lifting device being used to lift the telecom unit, in accordance with exemplary embodiments.
Figure 2D:
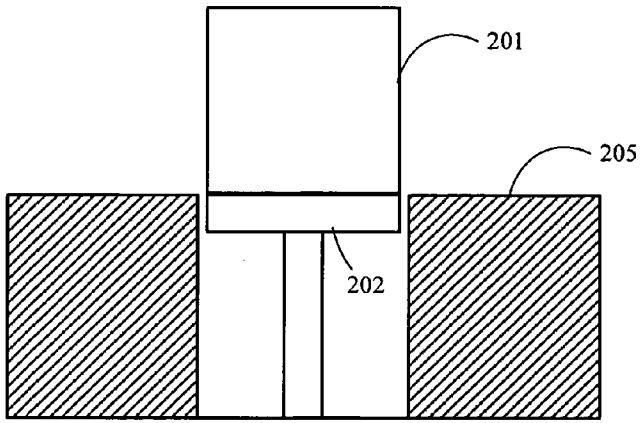

FIGS. 2C and 2D are schematic diagrams depicting a hydraulic version of the lifting device 202 being used to lift the telecom unit 201, in accordance with exemplary embodiments. Other implementations may use lifting devices 202 that are not hydraulic-based, such as devices that use pulleys and/or gears to transfer the force used for lifting the telecom unit 201. FIG. 2C shows the telecom unit 201 prior to being lifted by the lifting device 202, while FIG. 2D shows the telecom unit 201 after being lifted by the lifting device 202 out of the chamber 109. The telecom unit 201 can be lifted so that the unit's bottom part is approximately at ground level. Other implementations may include configuring the lifting device 202 so that the telecom unit 201 can be lifted to a level that is above or below ground level. The lifting device 202 may also be configured such that the level to which the telecom unit 201 is lifted can be controlled by an operator of the lifting device 202. The lifting device 202 may be operated via a control panel (not shown) that is attached, for example, to the telecom unit 201. The lifting device 202 may alternatively or additionally be operated via a remote control unit (not shown), such as, for example, a wireless communication device including, but not limited to, a cell phone, a PDA, a dual-mode phone, a computing device, or any other remote control device capable of providing a signal configured to operate the lifting device 202.

Figure 3A:
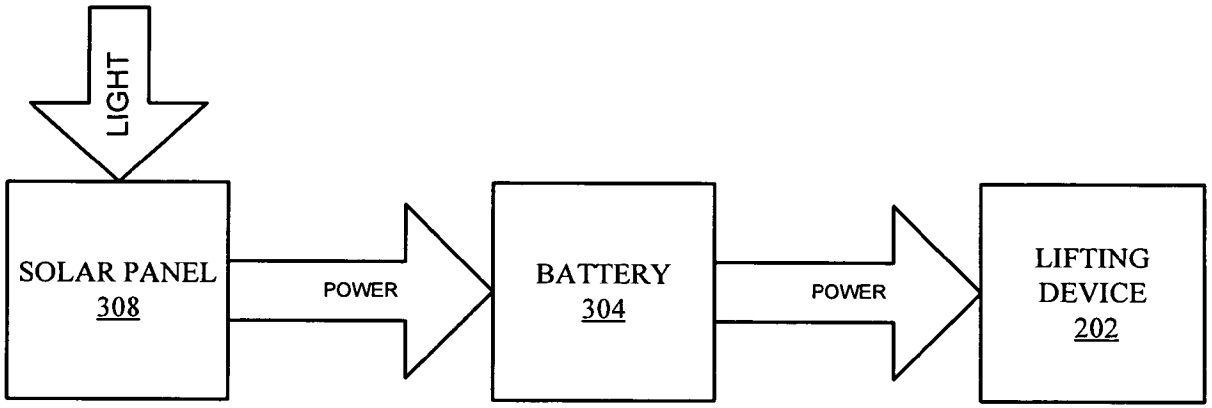
FIGS. 3A-3C are block diagrams illustrating respective power delivery systems, in accordance with exemplary embodiments.
Figure 3B:
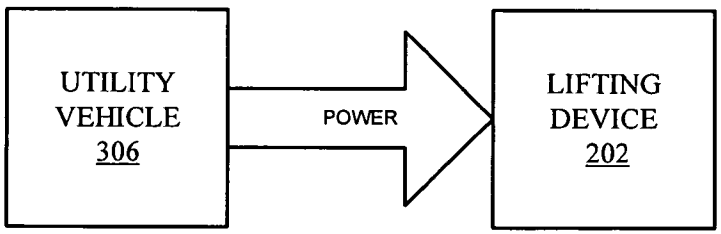
Figure 3C:
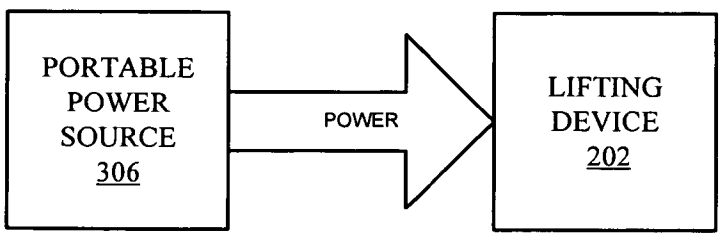

FIGS. 3A-3C are block diagrams illustrating respective power delivery systems, in accordance with exemplary embodiments. As illustrated in FIG. 3A, the lifting device 202 may be powered by a battery 304 that is recharged by a solar panel 308 or other means for providing power to the battery 304. The solar panel 308 converts solar energy into electricity. The solar panel 308 may be located on the telecom unit 201 in implementations where a cover, such as the cover 103, is not used for enclosing the telecom unit 201 in the chamber 109 or where a substantially transparent cover 103 is used. Alternatively, the solar panel 308 may be located on the cover 103 for the chamber 109. It should be understood by those skilled in the art that the solar panel 308 may be located anywhere in the vicinity of the battery 304 such that power from the solar panel 308 can be provided to the battery 304. The battery 304 may be located below the ground 205 or anywhere in the vicinity of the lifting device 202. Furthermore, the battery 304 may be integrated within the telecom unit 201 or the lifting device 202.

As illustrated in FIGS. 3B and 3C, the lifting device 202 may alternatively be powered via a utility vehicle 306 (e.g., a car or truck) or a portable power source 306, such as a portable battery. For example, an electric cord may be used to temporarily couple the utility vehicle 306's battery or the portable power source 306 to the lifting device 202. The system may be configured to enable more than one power source to be usable in connection with the lifting device 202, depending on a power source's availability. Having more than one usable power source enables a secondary power source to be used when the primary power source is not available.

Figure 4:
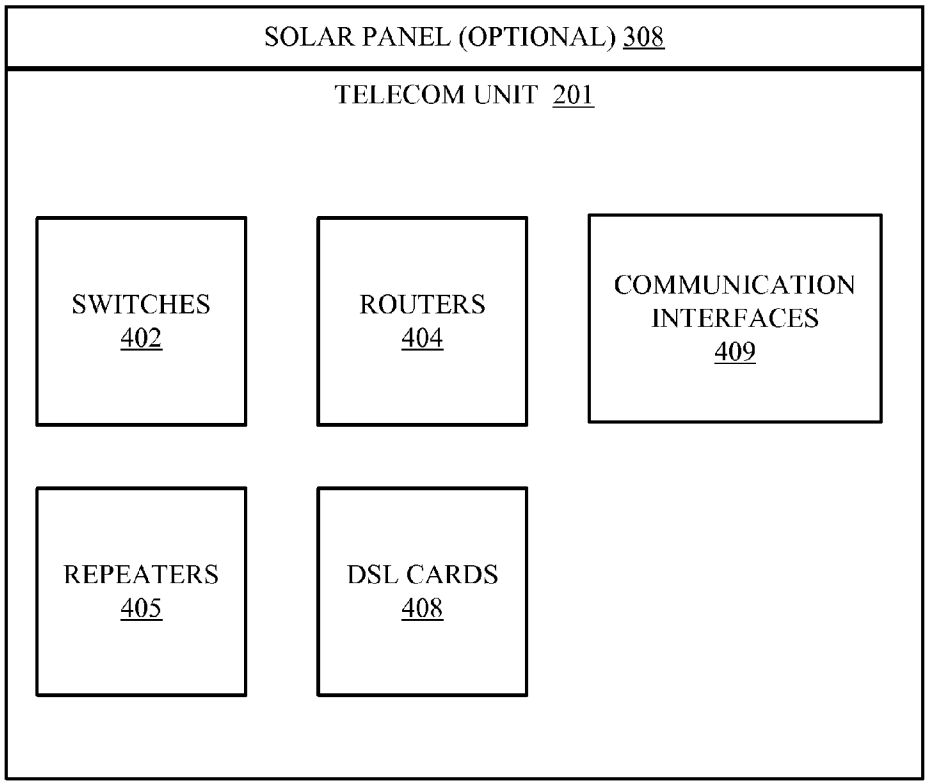
FIG. 4 is a block diagram depicting a telecom unit, in accordance with exemplary embodiments.

FIG. 4 is a block diagram depicting a telecom unit, such as the telecom unit 201, in accordance with exemplary embodiments. The telecom unit 201 includes devices for enabling wireline communications such as for telephones and/or computers. Different telecom units 201 may comprise different types of communication devices. The telecom unit 201 may include, for example, among others, one or more switches 402, routers 404, repeaters 405, communication interfaces 409, and/or DSL cards 408. Fewer, additional, and/or different devices may be used. An exemplary embodiment of the telecom unit 201 is a pedestal box used by a telephone company to enable telephone services for a certain area such as a neighborhood. An optional solar panel, such as the solar panel 308, may be attached to the telecom unit 201. The solar panel 308 can be used to charge the battery 304 used to power the lifting device 202 and/or charge a battery or other power source associated with the telecom unit 201.

Figure 5:
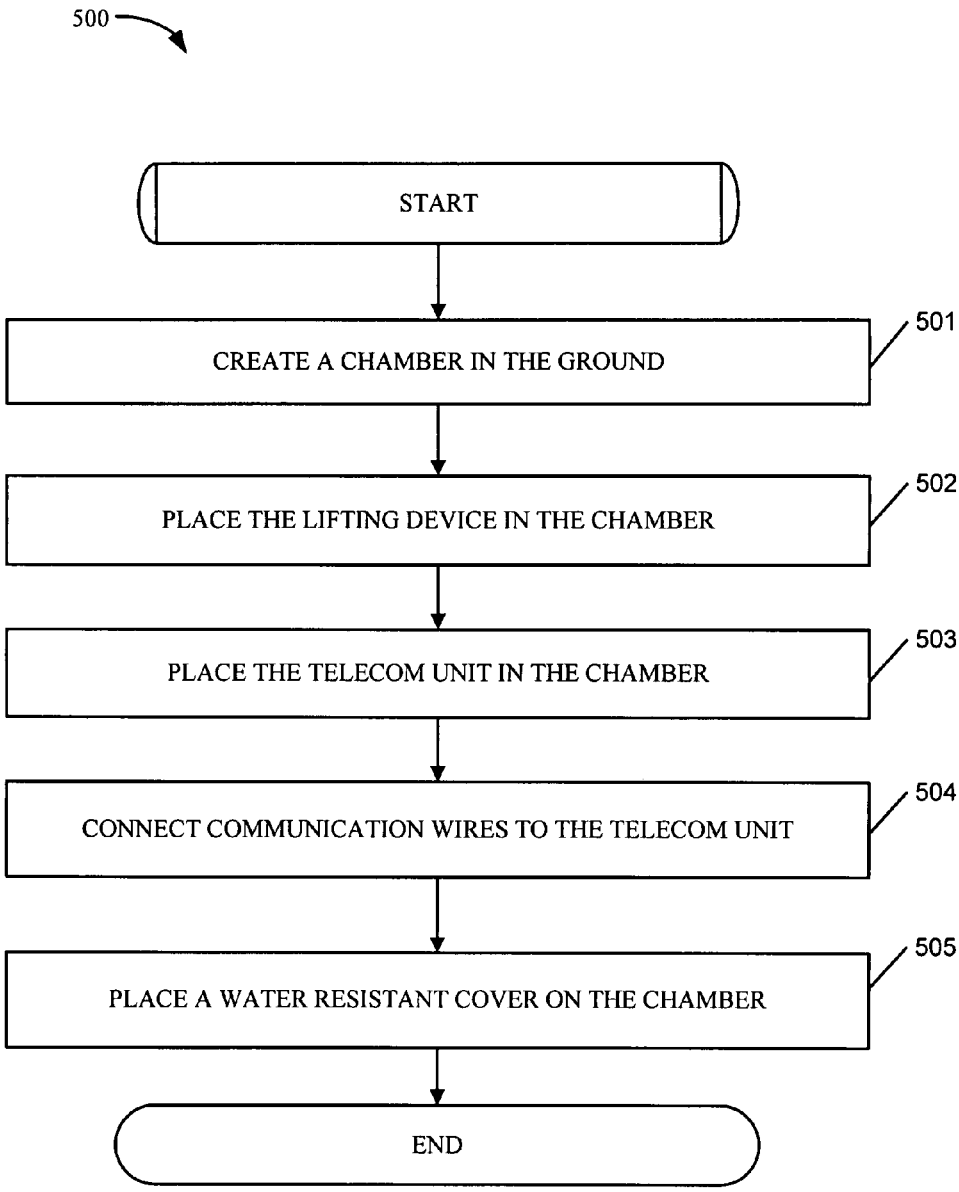
FIG. 5 is a flow chart depicting a method for creating the telecom unit access system shown in FIGS. 2A and 2B, according to exemplary embodiments.

FIG. 5 is a flow chart depicting a method 500 for creating the telecom unit access system 200 shown in FIGS. 2A and 2B, according to exemplary embodiments. As indicated in box 501 a chamber, such as the chamber 109, is created in the ground 205. The chamber 109 is created to be large enough to accommodate the lifting device 202 and the telecom unit 201. The lifting device 202 is then placed in the chamber 109, as indicated in box 502. As discussed above, the lifting device 202 may be configured to use any of a number of means for lifting the telecom unit 201. The telecom unit 201 is then placed in the chamber 109, as indicated in box 503. The telecom unit 201 is placed in a position that enables the lifting device 202 to lift the telecom unit 201 upon activation of the lifting device 202. Communication wires are then connected to the telecom unit 201, as indicated in box 504. If the communication wires had been previously connected to the telecom unit 201 or if no communication wires are required to be connected to the telecom unit 201, then the step corresponding to box 504 may be skipped. A water resistant cover 103 is then placed on the chamber 109, as indicated in box 505. The cover 103 may be configured to keep the chamber 109 tightly sealed to prevent water from leaking into the chamber 109. The cover 103 may be unnecessary if the telecom unit 201 is configured to be sufficiently water resistant. However, the cover 103 may be used even if the telecom unit 201 is water resistant since the cover 103 may protect the telecom unit 201 from damage caused by people or objects. Furthermore, the cover 103 may have a lock to prevent unauthorized access to the telecom unit 201.

Figure 6:
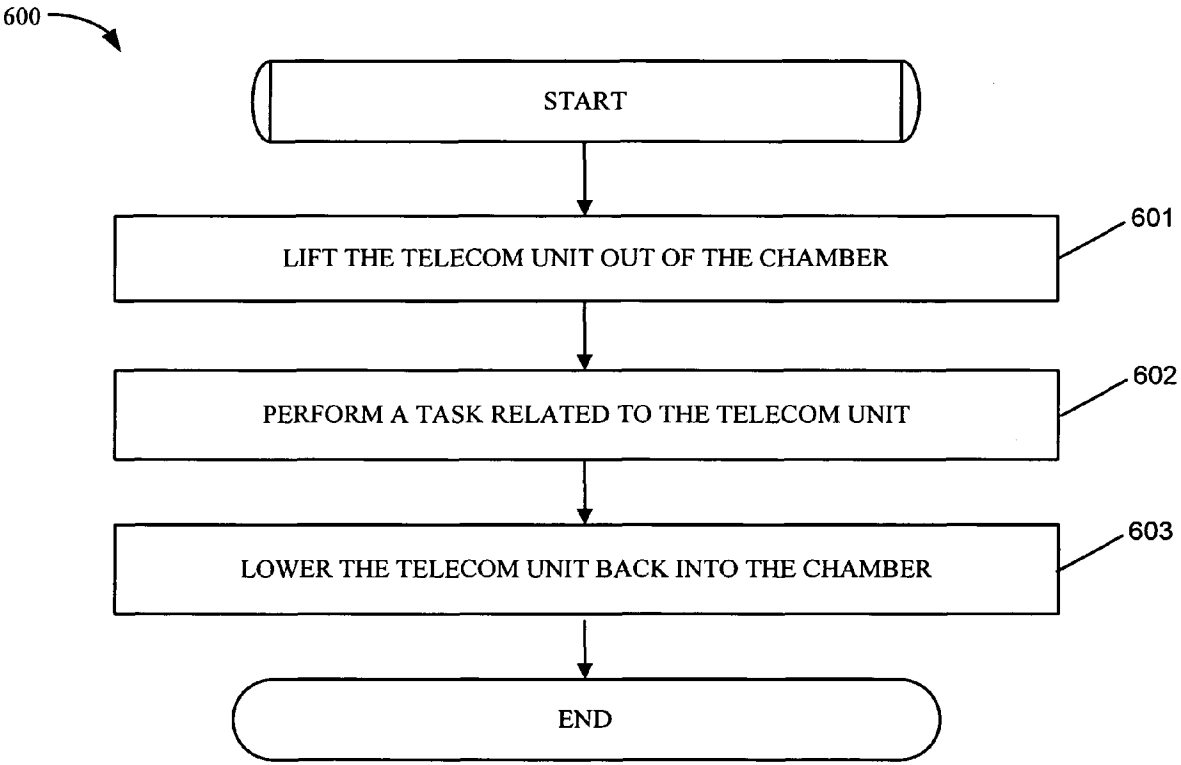
FIG. 6 is a flow chart depicting a method for using the telecom unit access system shown in FIGS. 2A and 2B, according to exemplary embodiments.

FIG. 6 is a flow chart depicting a method 600 for using the telecom unit access system 200 shown in FIGS. 2A and 2B, according to exemplary embodiments. As indicated in box 601, the telecom unit 201 is lifted out of the chamber 109. The telecom unit 201 may be lifted completely out of the chamber 109 or may remain partially in the chamber 109. The lifting device 202 may be used to lift the telecom unit 201. Alternatively, the telecom unit 201 may be manually lifted out of the chamber 109. If the chamber 109 has a cover, such as the cover 103, then the cover 103 may be opened or removed prior to the step indicated in box 601. A task related to the telecom unit 201 is then performed, as indicated in box 602. The task may include, for example, upgrading, repairing, or maintaining a device in the telecom unit 201. The telecom unit 201 is then lowered back into the chamber 109, as indicated in box 603. If the chamber 109 has the cover 103, then the cover 103 can be used to close the chamber 109.

Note that methods depicted in the exemplary flow charts described above may be modified to include fewer, additional, and/or different steps within the scope of this disclosure. Furthermore, steps depicted in the flow charts may be performed out of the order shown including substantially concurrently, in reverse order, or in a substantially different order.

Although the subject matter presented herein has been described in conjunction with one or more particular embodiments and implementations, it is to be understood that the embodiments defined in the appended claims are not necessarily limited to the specific structure, configuration, or functionality described herein. Rather, the specific structure, configuration, and functionality are disclosed as example forms of implementing the claims. Various modifications and changes may be made to the subject matter described herein without following the example embodiments and applications illustrated and described, and without departing from the true spirit and scope of the embodiments, which is set forth in the following claims.

What is claimed is:

1. A method for accessing wireline communication equipment, comprising:

positioning the wireline communication equipment at least partly below ground level;

positioning an electric-powered lifting device near the wireline communication equipment and at least partly below the ground level, wherein the electric-powered lifting device is configured to be powered by a power supply located at least partly below the ground level and wherein the power supply is charged by a solar panel located on the wireline communication equipment;

connecting the electric-powered lifting device to the wireline communication equipment; and configuring the electric-powered lifting device to lift the wireline communication equipment above the ground level when access to the wireline communication equipment is desired, wherein the electric-powered lifting device is further configured to receive a signal from a wireless communication device to lift the wireline communication equipment above the ground level.

2. The method of claim 1, wherein positioning the electric-powered lifting device at least partly below the ground level comprises positioning the electric-powered lifting device entirely below the ground level.

3. The method of claim 1, wherein positioning the wireline communication equipment at least partly below the ground level comprises positioning the wireline communication equipment entirely below the ground level.

4. The method of claim 1, wherein the electric-powered lifting device and the wireline communication equipment are positioned in a chamber that is at least partly below the ground level.

5. The method of claim 4, wherein the chamber has a cover and wherein repositioning the cover provides access to the chamber.

6. The method of claim 1, wherein the electric-powered lifting device is further configured to be powered by a further power supply located external to the electric-powered lifting device and the wireline communication equipment.

7. The method of claim 6, wherein the further power supply comprises a vehicle battery.

8. The method of claim 1, wherein the wireline communication equipment includes at least one of: a repeater, a router, a digital subscriber line (DSL) card, and a telephone switch.

9. The method of claim 1, wherein the wireline communication equipment is in a pedestal box.

10. The method of claim 1, wherein the electric-powered lifting device is a hydraulic lifting device.

11. A communication system comprising:

wireline communication equipment positioned at least partly below ground level; and an electric-powered lifting device positioned near the wireline communication equipment and at least partly below the ground level, the electric-powered lifting device being connected to the wireline communication equipment and being configured to lift the wireline communication equipment above the ground level when access to the wireline communication equipment is desired, the electric-powered lifting device further configured to receive a signal from a wireless communication device to lift the wireline communication equipment above the ground level and the electric-powered lifting device further configured to be powered by a power supply located at least partly below the ground level, wherein the power supply is charged by a solar panel located on the wireline communication equipment.

12. The communication system of claim 11, wherein the electric-powered lifting device positioned at least partly below the ground level comprises the electric-powered lifting device positioned entirely below the ground level and the wireline communication equipment positioned at least partly below the ground level comprises the wireline communication equipment positioned entirely below the ground level.

13. The communication system of claim 11, wherein the electric-powered lifting device and the wireline communication equipment are positioned in a chamber that is at least partly below the ground level.

14. The communication system of claim 13, wherein the chamber has a cover and wherein repositioning the cover provides access to the chamber.

15. The communication system of claim 11, wherein the electric-powered lifting device is further configured to be powered by a further power supply located external to the communication system.

16. The communication system of claim 15, wherein the further power supply comprises a vehicle battery.

17. The communication system of claim 11, wherein the wireline communication equipment includes at least one of: a repeater, a router, a digital subscriber line (DSL) card, and a telephone switch.

18. The communication system of claim 11, wherein the wireline communication equipment is in a pedestal box.

* * * * *